United States Patent [19]

Scott

[11] 4,276,371

[45] Jun. 30, 1981

[54] ROLL FASTENER FOR PHOTOGRAPHIC FILM

[76] Inventor: Peter R. Scott, 156 Grant Ave., Newton, Mass. 02159

[21] Appl. No.: 680,123

[22] Filed: Apr. 26, 1976

[51] Int. Cl.[3] ..... G03C 3/02

[52] U.S. Cl. ..... 430/501; 156/184; 206/813; 352/235; 430/11; 428/343; 428/355; 428/906; 430/12; 430/631

[58] Field of Search ..... 206/389, 455, 393, 398, 206/813; 96/78; 156/184; 352/233, 235; 428/906, 343, 355; 430/501, 11, 12, 631

[56] References Cited

U.S. PATENT DOCUMENTS

| | | | |
|---|---|---|---|
| 2,188,779 | 6/1940 | Roehrl | 96/78 |
| 2,751,309 | 6/1956 | Baxter | 96/78 |
| 2,857,047 | 10/1958 | Edelson | 206/412 |
| 3,021,229 | 2/1962 | Morgan | 96/78 |
| 3,196,034 | 7/1965 | Pandolfo | 206/389 X |
| 3,270,653 | 9/1966 | Bachelder | 96/78 |
| 3,549,482 | 12/1970 | Okutani | 428/40 |
| 3,592,340 | 7/1971 | Hoey | 206/389 X |
| 3,647,465 | 3/1972 | Shamay | 96/78 |
| 3,690,451 | 9/1972 | Nerwin | 96/78 X |
| 3,967,022 | 6/1976 | Hasei | 428/40 |

*Primary Examiner*—Edward C. Kimlin
*Assistant Examiner*—Edward C. Kimlin

[57] ABSTRACT

New means are providedfor securing the free end of a roll of photographic film against unwinding. The means comprises a strip of flexible plastic which clings to the photographic film, at the free end of the roll and also on the body of the roll adjacent the free end.

2 Claims, 6 Drawing Figures

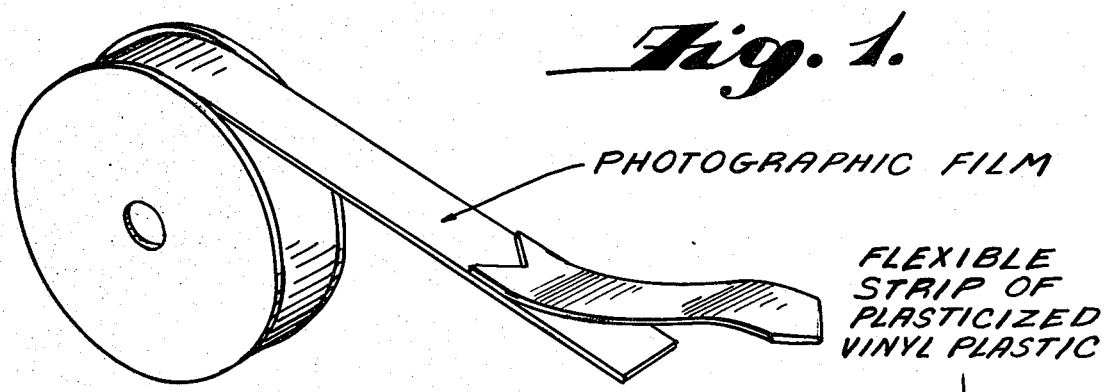
Fig. 1.
Fig. 2.
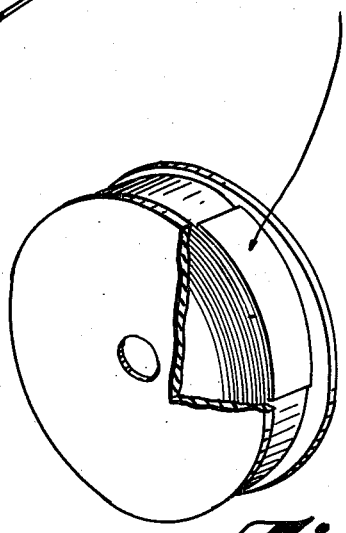
Fig. 6.
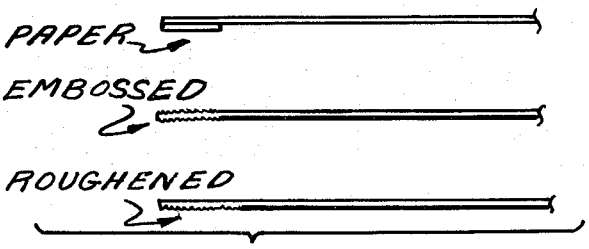
Fig. 3.
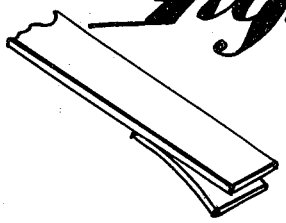
Fig. 4.
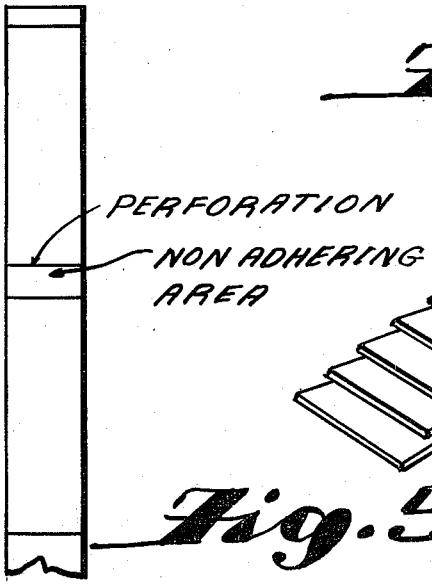
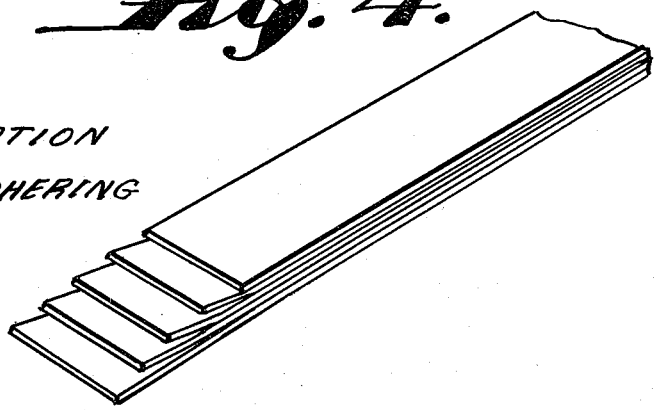
Fig. 5.

ROLL FASTENER FOR PHOTOGRAPHIC FILM

The present invention relates to a fastener for rolls of photographic film which has been wound onto reels to secure the free end of the roll against unwinding. As used herein, the term "photographic film" includes unexposed film, and exposed film, whether or not processed. The film may be microfilm, motion picture film, or any other kind of photographic film in roll form.

Photographic film normally comprises a photographic emulsion coated onto a transparent flexible backing of plastic material. The emulsion may comprise gelatin or other water soluble polymers in the case of silver film, or thermoplastic water resistant polymers in the case of vesicular films or other materials. At the present time, polyester films are preferred backing materials because of their combination of strength, durability and dimensional stability, but other backings such as cellulose acetate are widely used. Especially in the case of narrow rolls, say 8 millimeters to 105 millimeters width, it is customary to store lengths of film from a few feet to several thousand feet in length in rolls, wound onto cores or reels. Depending on various factors, the emulsion may face toward the center of the roll or outwardly. Unless the free end of the length of film is secured, the roll has a tendency to unwind, which is undesirable.

Various devices have been used to secure the free end of the film. One common device is a rubber band. However, many of the kinds of rubber bands which might be used have the capability of releasing substances which are harmful to the film and, unless selected properly, rubber bands may be too tight and can crimp the film. Another device, which has primarily been used for 35 millimeter film is a paper strip which has a paper button near one end and a string fastened to the button. The strip is wrapped around the roll of photographic film and the string is drawn around the roll and its free end is tied to the button. A third arrangement is a clip fastened to the free end of the film which engages the reel. Another sometimes-used device is a strip of pressure sensitive adhesive tape which has the possibility of leaving a harmful deposit on the film by virtue of the coating of pressure sensitive adhesive on the tape.

The present invention provides a simpler, less expensive, less harmful and entirely satisfactory means for securing the free end of a roll of photographic film to the exterior of the roll. Briefly, the arrangement is a short, flexible plastic strip which clings to the photographic film but which is not coated with a layer of adhesive. This strip can be speedily attached and removed without impairment of itself or the photographic film. The plastic may be plasticized vinyl, such as polyvinyl chloride or other vinyl chloride polymer, but other plastics which exhibit the same properties may be used. Such materials contain, e.g. 10% or more of plasticizer, based on the weight of the polymer. In general, the plastic contains at least 20% plasticizer by weight of the polymer. For many polymers, more than 50% is required and, in some instances, more than 100% will be used to achieve flexibility. The presently preferred material is 64% vinyl chloride polymer and 36% dioctyl phthalate plasticizer. Thus, the plastic clings to the photographic film by a mechanism different from pressure sensitive adhesive tapes and, therefore, is not subject to the same difficulties.

The strip of flexible plastic preferably is provided at one or both ends with an area which does not adhere to the photographic film. This makes it easier to lift the strip away from the photographic film when it is desired to unroll the film, for example, in threading it into a viewer. The area which does not adhere may be provided by means of a small piece of paper glued over the end portion of the plastic strip. Alternatively, a small area of the plastic strip may be roughened or embossed to a very irregular shape so that it will not cling to the photographic film.

The strip itself may be supplied in a roll of the flexible plastic with a succession of perforations at spaced intervals so that strips may be separated from the roll. Another type of package comprises a number of strips, laid one against the other, but each displaced laterally from its neighbor to extend beyond the edge of its neighbor so that a small area of the strip can be grasped to lift it from the stack. Other kinds of package will be readily apparent to those skilled in the art.

The strip may be preprinted. Indicia may be included providing instructions for use, advertising, identification or indexing information.

As noted above, the strip is made of plasticized vinyl or a similar material. The mechanism by which this strip adheres to the photographic film is believed to involve the release of a small quantity of the platicizer in the strip to its surface which fills any small spaces between the strip and the backing and which is held to both surfaces through surface tension. The phenomenon is believed to be similar to the phenomenon known as "tack" which is described by J. J. Bickerman in *The Science of Adhesive Joints* (Second Edition), Academic Press (1968). For this purpose, the strip should be as smooth as possible and also as flexible as possible. Consequently, the strip should not be any thicker than about 15 mil and may be as thin as 1 mil. The strip need not be as wide as the photographic film but it may be, for example, one half inch wide for use on films 16 millimeters to 105 millimeters in width. Such a strip preferably is 3 inches long. It could be somewhat shorter or longer and obviously could be wider or narrower depending on the dimensions of the photographic film involved. If desired, the strip can be sufficiently long to wrap completely around the roll or any portion of it. At present, a strip 10 mils thick is preferred.

The invention is illustrated in the drawings in which:

FIGS. 1 and 2 show a roll of photographic film with the flexible strip applied;

FIG. 3 shows various embodiments of the strip in side elevation with paper or other means to prevent one end of the strip from clinging to the photographic film;

FIGS. 4 and 5 depict pacakges for a supply of the strips; and

FIG. 6 depicts another embodiment of the invention.

The strip may be applied in different ways. In one form, as illustrated in FIG. 1, the strip is attached to the outer surface of the free end of the film but extends beyond the free end so that it can be attached to the body of the roll when the film is fully wound onto the reel or core. Alternatively, the strip may be attached to the inner surface of the free end of the film and then attached to the body of the roll under the free end, as shown in FIG. 6. In the latter case, the strip need not extend beyond the free end.

It will be appreciated that various changes may be made in the details of construction and the composition of the flexible strip without departing from the scope of the invention. Therefore, no limitation to the specific embodiments described is intended.

What is claimed:

1. In a roll of photographic film which comprises a photographic emulsion coated onto a plastic film backing having means for securing the free end of the roll against unwinding;

the improvement wherein said securing means comprises a strip of flexible plastic which clings to said photographic film and which is applied both to said free end and to the body of said roll adjacent said free end, said strip being free of adhesive coating.

2. In a method for securing against unwinding the free end of a roll of photographic film which comprises a photographic emulsion coated onto a plastic film backing, said method comprising holding said free end against the body of the roll;

the improvement wherein said free end is secured to the body of said roll by applying to said photographic film, both on said free end and on the body of said roll adjacent said free end, a strip of flexible plastic which clings to said film but which is free of adhesive coating.

* * * * *